United States Patent [19]

Smith

[11] Patent Number: 4,845,402

[45] Date of Patent: Jul. 4, 1989

[54] CATHODE RAY DISPLAY TUBE HAVING EXTERNAL MAGNETIC SHIELD

[75] Inventor: James Smith, Reigate, England

[73] Assignee: U.S. Philips Corporation, New York, N.Y.

[21] Appl. No.: 44,534

[22] Filed: May 1, 1987

[30] Foreign Application Priority Data

May 2, 1986 [GB] United Kingdom ..... 8610824

[51] Int. Cl.[4] ..... H01J 29/06; H01J 29/86

[52] U.S. Cl. ..... 313/422; 313/479; 315/85; 358/247; 174/35 MS; 250/515.1

[58] Field of Search ..... 313/422, 478, 479, 495, 313/313; 315/85; 358/247; 250/515.1; 174/35 MS

[56] References Cited

U.S. PATENT DOCUMENTS

| | | | |
|---|---|---|---|
| 2,942,254 | 6/1960 | Beers | 358/252 |
| 4,556,821 | 12/1985 | Cooper | 315/85 X |
| 4,631,214 | 12/1986 | Hasegawa | 315/85 X |
| 4,661,856 | 4/1987 | Schnack | 358/253 |

OTHER PUBLICATIONS

Handbook of Chemistry and Physics (CRC) 1971–1972, p. E108.

*Primary Examiner*—Donald J. Yusko
*Assistant Examiner*—Sandra L. O'Shea
*Attorney, Agent, or Firm*—John C. Fox

[57] ABSTRACT

A cathode ray display tube has a magnetic shield comprising a mesh (60) of high permeability magnetic material such as mumetal covering the outer surface of its transparent faceplate (14) through which a display from a screen (16) is visible and which together with a magnetic shielding box (70) surrounding the remainder of the tube's envelope (10) inhibits extraneous magnetic fields entering the envelope and affecting the electron beam undesirably. The shielding arrangement is particularly useful with a flat tube having a relatively large area faceplate and using a low-energy scanning electron beam (32). The mesh (60) may be supported by one or more transparent members (66), and may be treated to enhance contrast of the display and also to act as a electromagnetic radiation shield.

14 Claims, 1 Drawing Sheet

CATHODE RAY DISPLAY TUBE HAVING EXTERNAL MAGNETIC SHIELD

BACKGROUND OF THE INVENTION

This invention relates to a cathode ray display tube comprising an envelope containing means for generating an electron beam and a phosphor screen, and having a transparent faceplate through which the display produced by the screen is visible.

The invention is concerned particularly, although not exclusively, with a so-called flat cathode ray display tube generally of the kind described in British Patent Specification No. 2101396, corresponding to U.S. patent application Ser. No. 830,388, filed Feb. 14, 1986, now U.S. Pat. No. 4,737,690, which has a rectangular, box-like, metal rear housing covered by a substantially flat glass faceplate. In this tube, an electron gun directs a low-energy electron beam parallel to the screen and faceplate. The beam is then turned through 180° by means of a reversing lens at one end of the tube before being deflected to scan in raster fashion over the input side of an electron multiplier arranged parallel to, and spaced from, the screen. The beam undergoes electron multiplication within the multiplier and is then accelerated onto the screen by an accelerating field established between the output side of the multiplier and the screen in order to produce a display on the screen.

An advantage of this tube, made possible by the provision of an electron multiplier, is that the electron beam, before reaching the multiplier, need only be of comparatively low-energy, for example, a low voltage, low current beam having an acceleration voltage less than 2.5 kV and typically around 600V. Consequently deflection of the beam to achieve raster scanning, which is carried out prior to the multiplier by means of deflection electrodes, is rendered compact and simpler as only relatively small electrostatic fields are then necessary, the desired brightness of the display being achieved by the final acceleration of the current-multiplied beam emanating from the multiplier.

However, the use of a low energy electron beam in this way means that operation of the tube is particularly susceptible to the effects of extraneous magnetic fields. The sensitivity of the tube to ambient magnetic fields penetrating the envelope can be such that even the earth's magnetic field may interfere with the course of the electrons comprising the low-energy beam.

The problem of the influence of such magnetic fields on the operation of more conventional forms of cathode ray display tubes using a high energy electron beam and having a generally conical shape envelope has been recognised for some time.. It has therefore been suggested previously to surround much of the tube's conical envelope with soft magnetic material which provides useful magnetic screening from fields at rights angles to the main axis of the tube. However, with such an arrangement there remains a very large plane, the faceplate of the tube, which is not screened, especially from magnetic field components parallel to the axis of the tube.

The box-like rear housing of the aforementioned flat display tube can be screened in a similar manner by surrounding it with magnetic shielding material to alleviate to some extent the problem of extraneous magnetic fields influencing undesirably the trajectory of the electron beam within the tube. However, the faceplate of this tube comprises a relatively large area of the tube's envelope and the effects of magnetic fields entering the envelope through the faceplate are still very significant. The problem is increased because of the low-energy nature of the electron beam used in this tube and its greater susceptibility to magnetic fields, and also because much of the beam's path of travel is in directions parallel to the plane of the faceplate.

It is an object of the present invention, therefore, to eliminate, or at least reduce substantially, magnetic fields from entering through the faceplate of the cathode ray display tube and particularly, but not exclusively, the faceplate of the aforementioned flat kind of display tube using a low energy electron beam.

SUMMARY OF THE INVENTION

According to the present invention, a cathode ray display tube of the kind mentioned in the opening paragraph is characterised in that a magnetic shield comprising a mesh of high permeability magnetic material is positioned over the outside of the faceplate.

The provision of a mesh of high permeability magnetic material in this manner provides a simple and convenient solution and, in conjunction with a magnetic shield around the remainder of the envelope, has been found to be highly effective in substantially reducing magnetic fields entering the tube's envelope through the faceplate and at least reducing the field to a level inside the envelope such that its effect on the beam becomes less significant. For opaque shielding materials, optical transmission of the mesh depends on the area of the apertures of the mesh. Since magnetic screening capability depends on the material area, a compromise must be made between these two characteristics. By carefully choosing the ratio of the size of the apertures of the mesh to the area of the high permeability magnetic material defining the apertures adequate magnetic screening properties for the mesh can be achieved whilst sufficient optical transmission of the mesh to allow light produced by the screen passing through the faceplate outwards is obtained.

The mesh preferably comprises an apertured sheet of high permeability magnetic material having an array of regularly-spaced apertures. The magnetic material may comprise an alloy of the permalloy type, this type of alloy having a high magnetic permeability at low field strength and low hysterisis loss, or mumetal, a high permeability, low saturation magnetic alloy, or another magnetic alloy. Typically, such materials have a relative permeability greater than 20,000.

In order to avoid problems when viewing the display at angles other than normal to the faceplate and also for etching considerations, the mesh is made thin, for example, approximately 50 μm in thickness.

The array of apertures are preferably bordered by integral peripheral edge portions of the mesh free from apertures. These edge portions constitute a frame and provide support for the mesh for ease of handling and afford the mesh with increased mechanical strength. The dimensions of the apertured region of the mesh are at least as great as the dimensions of the screen of the tube and the peripheral edge portions are laterally offset from the screen so as not to obstruct light emission from the screen outwardly through the faceplate.

The apertures may be circular. In a preferred embodiment, however, the apertures are polygonal and defined by interconnected straight-edged bars of the magnetic material. The polygonal structure of the mesh allows both the screening and transmission properties of the mesh to be maximised more easily. In a preferred polygonally apertured mesh, the apertures are hexagonal and have a pitch of substantially 200 μm, corresponding approximately with the pixel pitch of the display, with the straight-edged bars having a width of substantially 40 μm. This mesh has an optical transmission of the order of 65% whilst still providing adequate magnetic screening. Such screening reduces significantly the strength of a magnetic field inside the tube's envelope caused by an external magnetic field applied perpendicular to the faceplate to a level that has a relatively insignificant effect on the electron beam trajectory. It has been found that with such a mesh, and in conjunction with a mumetal shield surrounding the remainder of the tube's envelope, around a 70% reduction in the strength of a magnetic field applied perpendicular to the faceplate is achieved within the envelope.

Where a shield of high permeability magnetic material, for example a box of mumetal sheet, is provided to surround the rear housing portion of the tube's envelope and screen that portion from external magnetic fields, the mesh of high permeability magnetic material positioned over the outside of the faceplate is preferably joined or overlaps closely around its periphery with that shield. Thus a fairly complete magnetic screening of the envelope's interior is obtained.

In order to enhance contrast of the display and minimise specular reflection of ambient light from the surface of the mesh facing the viewer, at least the outer surface of the mesh, i.e. the surface facing the viewer, may be blackened. This can be achieved using methods commonly known in the art.

The mesh may be coated with electrically highly conductive material, for example electroplated with silver, this operation being performed prior to the aforementioned blackening operation if used. By making the mesh highly conductive in this way, the mesh, when electrically well connected with the metal envelope of the tube or the shielding box surrounding the envelope, can also act as a transparent electromagnetic radiation shield for preventing electromagnetic signal radiation, for example, radio frequency signals, generated inside the tube from escaping through the faceplate, visible light electromagnetic radiation frequencies of course still being allowed through.

In a preferred embodiment, the mesh is supported by a transparent member, e.g. of glass, which is attached, either directly or indirectly, to the tube envelope. To prevent the risk of the mesh being accidentally damaged and to present a rugged assembly, the mesh may be laminated between two sheets of glass, or any other suitable transparent material of adequate rigidity, which are secured together. In one embodiment, the mesh may be laminated between two sheets of glass together with transparent plastics material which fills the apertures in the mesh, thereby excluding air and minimising internal optical reflections and maximising viewing angle.

One of these sheets of glass may, for simplicity of construction, comprise the faceplate.

BRIEF DESCRIPTION OF THE DRAWING

A cathode ray display tube in accordance with the present invention will now be described, by way of example, with reference to the accompanying drawing in which.

DESCRIPTION OF THE PREFERRED EMBODIMENTS

Figure 1:
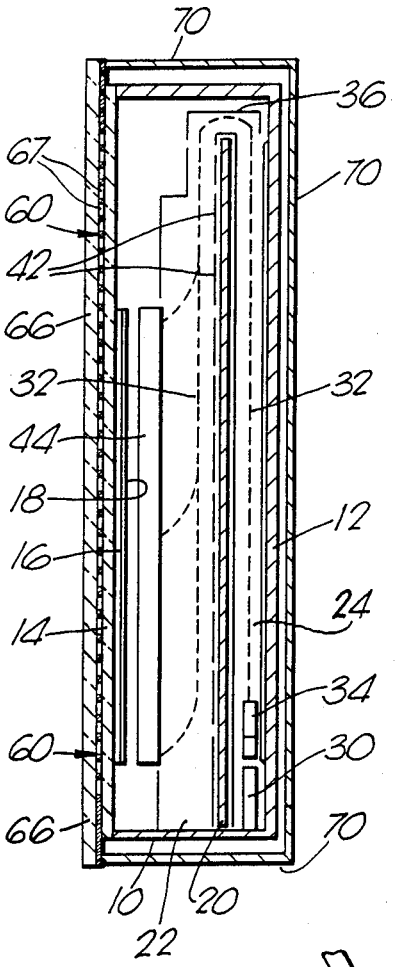
FIG. 1 is a schematic cross-sectional view through the display tube, in this case a flat display tube.

Referring to FIG. 1, there is shown a flat cathode ray display tube generally similar so far as its internal components and operation are concerned with the tube described in British Patent Specification No. 2101396, corresponding to U.S. patent application Ser. No. 830,388, filed Feb. 14, 1986. For a detailed description of its internal components and operation reference is invited to the aforementioned specification. Briefly, however, the tube has an envelope 10 formed by a rectangular box-like metal rear housing 12 defining a rear wall and upstanding side walls whose front opening is covered by a substantially flat glass faceplate 14. An internal partition 20 divides the interior of the envelope 10 vertically into a front portion 22 adjoining the faceplate 14 and a rear portion 24 which communicates with the front portion via a space between the upper edge of the partition and the upper side wall of the envelope. An upwardly directed electron gun 30 and electrostatic line deflector 34 are disposed in the rear portion 24. The electron gun 30 generates a low-current, low-energy electron beam, with an energy of, say, 400–1000 electron volts, which travels upwardly of the tube parallel to the rear wall of the envelope 10 and the faceplate 14. Having passed through the deflector 34, the line deflected beam 32 is directed to a 180° reversing lens 36 which deflects the beam into the front portion 22. An electron multiplier 44 is disposed in the front portion 22 parallel and adjacent to, but spaced from, the faceplate 14. The electron beam 32 in the front portion 22 undergoes frame deflection by means of a plurality of selectively energised, vertically spaced, horizontally elongate electrodes 42. The pattern of energisation of the electrodes 42 is such as to deflect an end portion of the electron beam toward the input side of the electron multiplier 44, the point of deflection being controlled progressively by the electrodes 42 so that the beam scans frame-wise from an upper edge to a lower edge of the multiplier. As a result of the actions of the line deflector 34 and electrodes 42 therefore, the low energy electron beam 32 is scanned in raster fashion over the input side of the multiplier 44. The beam undergoes current (electron) multiplication within the multiplier and upon emanating from the output side of the multiplier 44, facing the faceplate 14, is accelerated towards a phosphor screen 16, carried on the inside surface of the faceplate, by means of a high voltage accelerating field established between the output side of the multiplier 44 and an electrode layer 18 on the surface of the screen 16.

In accordance with the present invention, the tube further includes a magnetic shield comprising a planar mesh 60 of high permeability, soft magnetic material positioned over the outside of the faceplate 14. The mesh 60 of the embodiment comprises an apertured sheet of mumetal material, this material, as is generally well known, being a high relative permeability, low saturation magnetic alloy of about 80% nickel with low loss properties. Other soft magnetic alloys, having a high relative permability typically greater than 20,000 such as a permalloy material, may be used instead to form the mesh 60.

Figure 2:
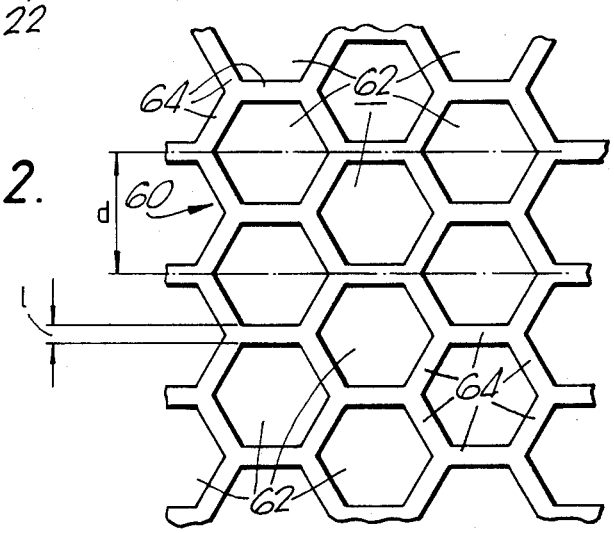
FIG. 2 is a highly enlarged plan view of a fragmentary portion of a magnetic screening mesh applied over the faceplate of the display tube.

As can be seen clearly from FIG. 2, the mesh 60 comprises a regular array of identical hexagonal apertures 62 defined by interconnected straight-edged bars 64 of mumetal material. The pitch of the apertures, d, is in the order of 200 μm and the width of the bars, 1, is in the order of 40 μm. This gives an effective transmission of light emitted by the screen 16 and passing through the faceplate 14 of around 65% which has been found to be entirely acceptable for viewing a display. The mesh has a thickness of around 0.050 mm.

For mechanical strength the mesh 60 is supported over and against the faceplate 14 by a flat glass sheet 66 substantially co-extensive with the faceplate 14. The combination of the sheet 66 and mesh 60 bonded thereto are mounted on the tube envelope by any suitable securing means located outside the display area determined by the screen 16. The mesh 60 is thus sandwiched between the faceplate 14 and the sheet 66, this arrangement giving protection and support to the mesh.

In an alternative arrangement, the mesh 60 is sandwiched for mechanical strength between the two sheets of glass secured together and the sandwich assembly is attached to the envelope over the faceplate 14, thereby enabling the enclosed, and hence, protected, mesh 60 to be conveniently mounted on, and removed from, the envelope 10 as and when required without risk of damage being caused to the mesh.

In both the above arrangements the mesh 60 may be laminated between the two glass sheets, (one of which in the first arrangement comprises the faceplate), together with one or more layers of optically transparent plastic material such as polyvinyl butyral, the laminate assembly being subjected to heat and pressure so as to cause the plastic material, referenced as 67 in FIG. 1, to flow between the mesh 60 filling its apertures and forcing out air. This produces a glass/plastic/glass bond. Because the plastic material has approximately the same refractive index as the glass, reflections at the boundaries are reduced, thus minimising internal reflections.

Although the array of apertures in the mesh 60 could extend completely over the area of the mesh, it is preferred that the peripheral edge portions are free of apertures, with the array of apertures covering only an area corresponding approximately with the area of the screen 16 on the faceplate 14. These integral peripheral edge portions of the mesh 60, consisting of plain mumetal sheet around 15 mm in width, constitute a frame bordering the apertured region of the mesh and afford a degree of structural strength to the mesh for ease of handling. In use of the mesh, these peripheral edge portions lie outside the screen area of the faceplate and so do not interfere with viewing.

The display tube includes magnetic shielding in the form of a box-like structure 70 made from mumetal sheet material which surrounds the rear housing 12 of the envelope. The free ends of the side walls of the shielding structure 70 physically contact with the peripheral edge portions of the mesh 60 completely therearound, those edges being, as shown, deliberately exposed by extending them beyond the faceplate 14 for this reason, so that magnetic flux can flow between the mesh 60 and structure 70 efficiently. In this way the envelope 10 is totally enclosed by magnetic shielding material, the mesh partially closing the leaky window area of the structure 70 and serving to prevent magnetic fields entering the envelope through the faceplate. Instead of physically contacting one another, the shielding structure 70 and the mesh 60 may simply be arranged to overlap one another closely. The manner by which contact, or overlap, between the structure 70 and the mesh 60 is achieved may take other forms. Moreover, the structure 70 might be extended to cover upper and lower portions of the faceplate 14 with the mesh 60 covering only an area of the faceplate slightly larger than the screen area.

When a cathode ray display tube of the kind described but without magnetic shielding afforded by the mesh 60 and the structure 70 was subjected to a magnetic field of 160 ampere/meter directed perpendicular to the plane of the faceplate 14, the magnetic field strength inside the envelope 10 at the centre of the screen 16 was found to be 53.3 ampere/meter. With the mesh 60 and structure 70 present as shown in FIG. 1, the magnetic field within the envelope was found to be reduced to 16 ampere/meter. Thus a considerable reduction, around 70%, in the strength of a magnetic field entering the envelope 10 through the faceplate 14 is achieved. The reduced level of magnetic field strength within the envelope is such that the trajectory of the electron beam is not unduly impaired and the effect of the field becomes almost negligible.

The mesh 60 is fabricated by standard photolithographic and spray-etching techniques using ferric chloride solution.

In order to improve contrast of the display and minimise the reflective effect of the mesh 60 an ambient light, the outward facing surface of the mesh may be blackened using any convenient known technique, for example by electroplating the mesh with a thin layer of copper and oxidising this by, for example, a mixture of potassium persulphate and sodium hydroxide.

The magnetic field screening mesh 60 may readily be adapted to fulfil an additional function as an electromagnetic radiation shield to prevent or reduce electromagnetic radiation interference, for example radio frequency signals, passing through the faceplate, and particularly to suppress electromagnetic signal radiation from the interior of the envelope 10. To achieve this end, the mesh 60 is coated to a greater thickness with electrically highly conductive material, this step being taken prior to the aforementioned blackening operation if used. In one method, it is proposed that the mesh 60 is electroplated with copper or silver to around a thickness of 0.01 mm. The coated mesh 60 is electrically well connected to the rear-housing 12 of the tube, (or the structure 70), which itself acts as an electromagnetic radiation shield and which, together with the mesh 60, completely surrounds and shields the envelope interior and is grounded.

I claim:

1. A cathode ray tube comprising an envelope containing means for generating an electron beam and a phosphor screen and having a transparent faceplate through which the display produced by the screen is visible, a magnetic shield comprising a mesh of high permeability magnetic material positioned over the outside of the faceplate, the mesh comprising an apertured sheet of the magnetic material having an array of regularly spaced apertures, characterized in that the apertures of the array are polygonal and defined by interconnected straight edged bars of the magnetic material.

2. A cathode ray display tube according to claim 1, characterised in that the magnetic material comprises a magnetic alloy.

3. A cathode ray display tube according to claim 2, characterised in that the magnetic material comprises mumetal material.

4. A cathode ray display tube according to claim 2, characterised in that the magnetic material comprises permalloy.

5. A cathode ray display tube according to claim 1, characterised in that the mesh is around 50 μm in thickness.

6. A cathode ray display tube according to claim 1, characterised in that the array of apertures are bordered by integral peripheral edge portions of the mesh free from apertures.

7. A cathode ray display tube according to claim 1, characterised in that the apertures are hexagonal and have a pitch of substantially 200 μm with the straight-edged bars having a width of substantially 40 μm.

8. A cathode ray display tube according to claim 1, being provided with a shield of magnetic material surrounding the rear housing portion of the envelope, characterised in that the mesh is joined or overlaps closely with the shield around its periphery.

9. A cathode ray display tube according to claim 1, characterised in that at least the outer surface of the mesh is blackened.

10. A cathode ray display tube according to claim 1, characterised in that the mesh is coated with electrically highly conductive material so as to act as an electromagnetic signal radiation shield.

11. A cathode ray display tube according to claim 1, characterised in that the mesh is supported by a transparent member which is attached to the envelope.

12. A cathode ray display tube according to claim 11, characterised in that the mesh is sandwiched between two transparent members which are secured together.

13. A cathode ray display tube according to claim 12, characterised in that one of the said transparent members comprises the faceplate.

14. A cathode ray display tube according to claim 12, characterised in that optically transparent plastic material is disposed between the two members and fills the apertures in the mesh.

* * * * *